United States Patent [19]

Jones

[11] Patent Number: 4,675,480

[45] Date of Patent: Jun. 23, 1987

[54] MECHANICAL UNGUIDED BALLISTIC MISSILE NEAR SURFACE FUZING SWITCHES

[76] Inventor: W. Dale Jones, 7020 Aztec Dr., N.E., Albuquerque, N. Mex. 87110

[21] Appl. No.: 522,318

[22] Filed: Aug. 11, 1983

Related U.S. Application Data

[63] Continuation-in-part of Ser. No. 493,782, May 12, 1983, abandoned.

[51] Int. Cl.[4] ..... H01H 35/14

[52] U.S. Cl. ..... 200/61.53; 102/262

[58] Field of Search ..... 200/61.53, 82 R, 61.53, 200/82 R; 102/262, 272, 273

[56] References Cited

U.S. PATENT DOCUMENTS 3,715,535 2/1973 Urenda ..... 200/61.53

3,909,569 9/1975 Jones ..... 200/61.53

*Primary Examiner*—Theodore M. Blum

*Attorney, Agent, or Firm*—Basile Weintraub & Hanlon

[57] ABSTRACT

A shock-damped and electronically passive mechanical switch system is precisely responsive to unguided ballistic missile peak reentry drag levels and respective near surface drag levels. The system includes a single cylindrical case containing a first and a second switching piston independently biased by respective springs, and a third switching piston housed in the second piston and controlled by metering fluid. The third (arming) piston begins displacing upon sensing a calibrated low threshold missile reentry drag value and shortly thereafter opens a port which enables the first and second pistons to begin displacing in response to the missile's drag, these two pistons coming to rest upon sensing the missile's peak drag. The second (programming) piston retains its peak drag sensing position to thus program the near surface drag value as the first piston retracts in response to the missile's reducing post peak drag. The third piston reaches its arming position between the missile's peak drag and near surface drag experiences. The first (near surface drag switching) piston closes the warhead fuzing circuit as it senses the near surface drag value programmed by the second piston.

1 Claim, 9 Drawing Figures

MECHANICAL UNGUIDED BALLISTIC MISSILE NEAR SURFACE FUZING SWITCHES

CROSS REFERENCE TO RELATED PATENT APPLICATIONS

This patent application is a continuation-in-part application of Ser. No. 493,782 filed May 12, 1983, now abandoned, in the name of W. Dale Jones.

BACKGROUND OF THE INVENTION

The present invention relates to arm and fuze switching systems of unguided ballistic missiles. In keeping with advancements of ballistic missile countermeasure technology, considerable research and development effort has been directed toward increasing the capability of ballistic missile arm and fuze switching systems to withstand the effects of such countermeasures. Two intended reliability improvements of one such switching system were the self-setting mechanical timer disclosed in U.S. Pat. No. 3,614,465 and the two-level drag switch designed to control the functions of the mechanical timer and disclosed in U.S. Pat. No. 3,715,535. These two devices were developed for the purpose of redundantly, with the highly-accurate pre-launch programmable electric timer, turning on the radar. However, these devices have been found unsatisfactory in improving reliability of the arm and fuze switching system in that the mechanical timer takes precedence over the electric timer and turns on the radar at abnormally high elevations in most missile trajectories to substantially increase the warhead's vulnerability to radar-aided countermeasures.

Considerable effort has also been directed toward the problem of electronically fail safing ballistic missile arming and fuzing systems against premature actuation and actuation in response to countermeasure proximity blast effects. A result of this effort was development of the fluid metering and single integrating drag switch disclosed in my U.S. Pat. No. 3,909,569. This fail safing or arming switch principle, in turn, made possible the invention "Mechanical Ballistic Missile Near Surface Fuzing Switches", disclosed in my U.S. patent application Ser. No. 345,068, filed on Feb. 2, 1982.

The present invention relates directly to that of Ser. No. 345,068 in that it eliminates the roller band mechanism and the need for flow compensation of the metering fluid of the arming switch, otherwise required because of temperature-caused variance of the viscosity of the switch's metering fluid. These simplifications, in turn, permit the present invention to be housed in a single cylindrical case rather than the original two cases.

In comparison with representative conventional unguided ballistic missile arming and fuzing systems requiring an electric timer, a radar and several ancillary components, the present invention reduces space requirements by approximately 50 percent, reduces cost by an estimated 80 percent, overcomes susceptibility to premature switching attendant to high elevation proximity blast and radar-aided countermeasures, and insures minimal near surface fuzing elevation errors in both perturbed and unperturbed missile missions.

SUMMARY OF THE INVENTION

If an unguided ballistic missile system involves constant launch velocity and variable launch angle, for any given peak missile reentry drag value there is a respective single near surface drag value. Accordingly, the present invention's first embodiment constitutes a single inert fluid filled and hermetically sealed and electrically insulative cylindrical case incorporating thousands of helically arranged and wall embedded electrical contacts; an electrically insulative peak drag switching (programming) piston and an electrically insulative near surface drag switching piston, each piston slidably disposed closely in the case and supported therein by mercury piston rings and each piston incorporating a round switching member having its edge periphery mercury wetted to make sliding electrical contact with the case wall embedded contacts; a helical compression spring and a helical extension spring, each spring electrically insulated and connected to the respective switching members of the programming and near surface drag switching pistons and each spring connected to a circuit wire at opposing ends of the case; and a small, fluid metering, orifice-controlled arming piston, of the type disclosed in my U.S. Pat. No. 3,909,569, cylindrically embodied in the programming piston and associating with a pair of normally open contacts within the programming piston.

Calibration-chosen peak drag contacts of the case wall are wired, via external jumpers, to respective calibration-chosen near surface drag contacts of the case wall via a modified conventional stitch wiring process. Both the programming piston and the near surface drag switching piston incorporate fluid passageways therethrough, the former of which closes in a check valve manner to prevent the programming piston from retracting in response to sensed decreasing missile drag. A means is provided for returning the programming piston to its normal rest position following its forward displacements in calibration and testing functions.

In operation, the invention would be mounted with its axis coinciding with the warhead's axis and with its forward end facing the missile's nose. The arming piston would begin displacing forwardly, metering fluid, upon sensing a calibrated low missile reentry drag value. Shortly thereafter the advancing arming piston would open a port associated with the programming piston's fluid passageway, thereby enabling the programming piston and the near surface drag switching piston (located behind the programming piston) to begin advancing in response to sensed missile increasing drag, under the constraints of their respective springs. The programming piston and the near surface drag switching piston would come to rest upon sensing the missile's peak reentry drag. The programming piston would retain its peak drag sensing position, by virtue of its check valve feature, where its switching member would, via engagement with peak drag contacts, program the missile's respective near surface drag value. The arming piston would reach its arming circuit completing position, where its mercury piston ring would bridge a pair of normally-open contacts in the programming piston, between the missile's peak drag and near surface drag experiences. The near surface drag switching piston, retracting in response to the missile's decreasing post peak drag, would close the warhead fuzing circuit as its switching member engages the near surface drag contact circuit connected to the most forward of the peak drag contacts engaged by the switching member of the programming piston.

If an unguided ballistic missile system involves varying launch velocity and varying launch angle, for any given peak missile drag value there are many possible near surface drag values, depending on the launch velocity. Accordingly, the near surface drag switching piston of the invention's second embodiment, designed for such systems, is designed such that the axial location of its switching member can be pre-launch established. The second embodiment's peak drag contacts are wired to the greatest possible near surface drag contacts related to the peak drag values. Also, the normal axial location of the switching member of the near surface drag switching piston assumes the greatest possible near surface drag values of the various trajectories would be applicable. Thus, if the missile's planned trajectory entails the greatest of the possible near surface drag values related to the expected peak drag value, the location of the switching member of the near surface drag switching would be left unadjusted. However, if the expected near surface drag value is less than the greatest possible value, the switching member of the near surface drag switching piston would be programmed at an axial location recognizing the expected difference. Except for difference of design of the near surface drag switching pistons, differences of axial location of the near surface drag contacts and elongation of the case of the invention's second embodiment, the design of the invention's two embodiments are the same. Also, the inflight operating principles of the two embodiments are the same.

Since the invention is wired to relate missile near surface drag values with respective missile peak reentry drag values, as influenced by differences of launch angle, errors in achieving desired launch angle would not contribute toward elevation error of the near surface fuzing function. Moreover, since near surface drag values vary directly with respective peak drag values, error in achieving desired launch velocity and missile slow-down attendant to high elevation proximity blast perturbation, resulting in like sign differences between expected and actual peak drag and near surface drag, would, because of this compensating feature, contribute only slightly and moderately, respectively, toward elevation error of the near surface fuzing function.

The invention's high degree of near surface fuzing accuracy is further enhanced by its small average drag resolution error of 0.063 g inherent in resolving drag in increments of only 0.25 g. This highly precise drag resolution capability is made possible by the thousands of case wall embedded contacts from which functional contacts are calibration-chosen, via a centrifuge, with reference to a master unit of the invention calibrated under end use conditions via simultaneously telemetered and taped recordings. This high degree of accuracy is still further enhanced by the invention's minimal drag sensing error, since the effects of sensing errors attendant to variance of the spring rates and spring and piston frictions among production units are virtually nullified via the invention's equivalent end use calibration method.

Statistical combination of the average effects of these small near surface switching elevation error causes and the error effects of nominal variance of a representative unguided missile's ballistic coefficient and yaw of repose (from that which would be experienced when calibrating the master invention unit) provides theoretical average near surface fuzing elevation errors of less than 100 yards and plus 200 yards, respectively, for representative average unperturbed missions and assumed proximity blast perturbed missions.

DESCRIPTION OF PREFERRED EMBODIMENTS

Figure 1:
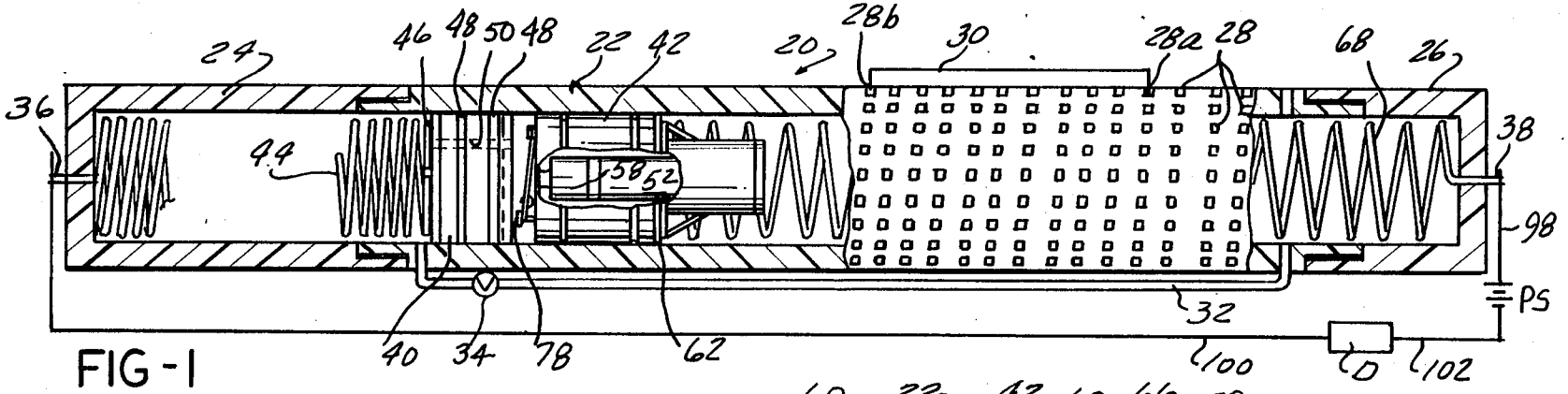
FIG. 1 is a side elevational view, with certain parts broken away or shown in section, of an inertia switch system embodying the present invention.

Referring first to FIG. 1, the present invention's first embodiment includes a cylindrical casing designated generally 20 which includes an open-ended central section 22 whose opposite ends are closed and hermetically sealed by end caps 24 and 26. The three sections 22, 24 and 26 of casing 20 are preferably formed of an electrically nonconductive material, such as the high-glass content diallyphthalate described in my U.S. Pat. No. 3,909,569. This particular material is capable of being machined to precise tolerances and is dimensionally stable in the face of wide temperature ranges.

A helical array of electrical contacts 28 is integrated with casing 20, in the manner described in my U.S. Pat. No. 3,909,569. The inner and outer surfaces of contacts 28 are machined flush with the inner and outer surfaces of casing 20. Peak drag contacts **28*a*, calibration-chosen from contacts 28, are externally connected by jumpers 30 to respective calibration-chosen near surface drag contacts 28*b*. For clarity, only one such interconnection by a jumper 30 is shown. In practice, approximately eight percent of contacts 28 would become functional as contacts 28*a* or 28*b*** and these contacts would be jumper-connected via a modified conventional semi-automatic stitch wiring process.

A bypass conduit 32 extends the entire length of central section 22, opening into the interior of section 22 adjacent each end. A normally closed shut-off valve schematically indicated at 34 normally closes conduit 32, but may be opened manually to permit the flow of fluid between the opposite ends of the interior of casing 20.

At opposite ends of casing 20, electric terminals 36 and 38 are respectively embedded in and pass through the end walls of end caps 24 and 26.

When assembled, central section 22 and end caps 24 and 26 are mechanically and hermetically sealed to each other to thus seal the interior of casing 20. The interior of the casing is filled with a fluid, preferably an inert gas.

A first (near surface drag switching) piston 40 and a second (peak drag or programming) piston 42 are slidably received within the interior of casing 20 for independent sliding movement. Piston 40 is normally resiliently biased to the position shown in FIG. 1 by an electrically conductive extension spring 44 which is mechanically and electrically connected at one end to terminal 36 and is mechanically and electrically connected at its right-hand end, as viewed in FIG. 1, to an electrically conductive switch plate 46 fixedly secured to the left-hand end of piston 40. The periphery of switch plate 46 is accurately machined flush with the peripheral surface of piston 40 and its periphery is mercury wetted to be a continuous sliding contact with the interior surface of casing 20 so that electrical contact will be made between switch plate 46 and the various contacts 28 as piston 40 moves through the interior of casing 20.

Piston 40 is formed from an electrically non-conductive material which is preferably the same as that from which casing 20 is formed, and a pair of mercury filled grooves 48 slidably seal piston 40 to the interior wall of the casing. A relatively large through passage 50 extends axially through piston 40 and switch plate 46 to accommodate a substantially unrestricted flow of fluid from one side of piston 40 to the other so that the only restraint to inertially induced movement of piston 40 within the casing is provided by the biasing action of spring 44.

Figure 2:
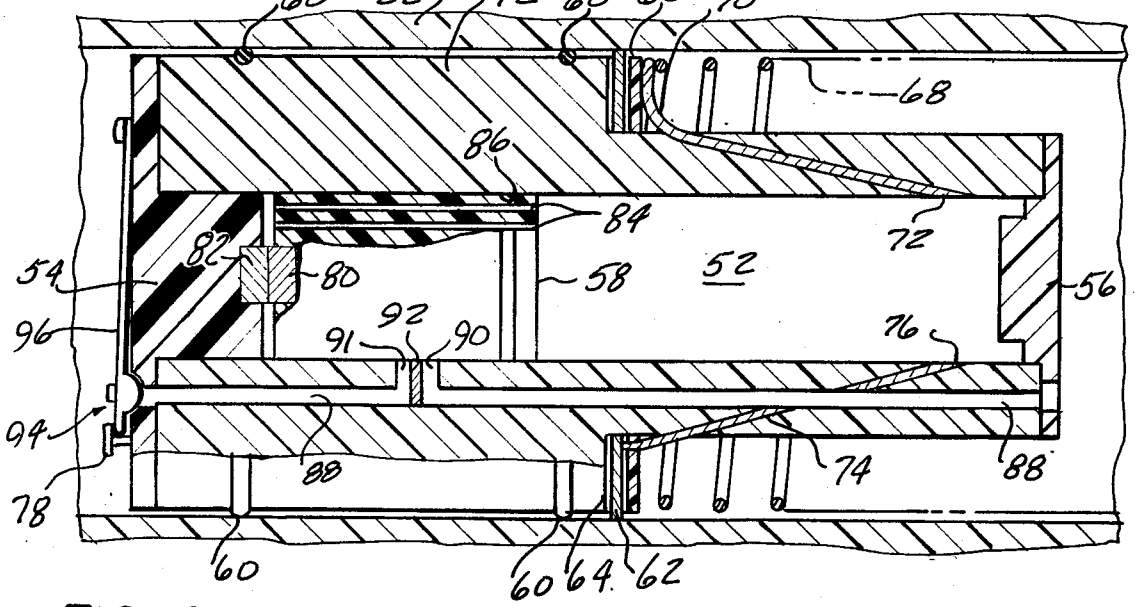
FIG. 2 is a detail cross-sectional view of one of the piston assemblies of the system of FIG. 1.

Details of the second piston 42 are best shown in the cross-sectional view of FIG. 2. Piston 42 is formed of an electrically nonconductive material, preferably the same material as that of casing 20, and a central bore extending coaxially through the piston defines a chamber 52, closed and sealed at opposite ends by end caps 54 and 56, which slidably receives a third (arming) piston 58.

Like piston 40, a pair of mercury filled grooves 60 around the periphery of piston 42 slidingly seal the piston to the interior wall of the casing. An electrically conductive metal plate 62 is fixedly secured, as by bonding, to the rightwardly facing shoulder 64 of piston 42. The outer periphery of plate 62 is mercury wetted in the same manner as switch plate 46 of piston 40 and, as in the previous case, the mercury wetted periphery of plate 62 will be in sliding mechanical and electrical contact with the inner surfaces of the various contacts 28 in the casing wall as piston 42 moves back and forth within the casing.

A ring 66 of electrical insulating material is bonded to the outer surface of plate 62 to electrically isolate plate 62 from electrically insulated compression spring 68. Electrically conductive terminal 70, which mechanically and electrically attaches to the left-hand end of spring 68, passes through the wall of piston 42 and has an inner end 72 which is machined flush with, but exposed at, the wall of the chamber 52. A similar electric terminal 74 has its end 76 exposed to the interior of chamber 52 and passes through the wall of piston 42 and through insulating ring 66 to be mechanically and electrically connected to switch plate 62. Spring 68 resiliently biases piston 42 to the rest position shown at FIG. 1 at which the head of a stop screw 78 engages the right-hand face of piston 40. The opposite end of spring 68 is mechanically and electrically connected to terminal 38.

Piston 58 is formed of an electricaly nonconductive material and has a magnetizable slug of ferrous metal 80 fixedly embedded in the left-hand end of the piston as viewed in FIG. 2. A permanent magnet 82 fixedly mounted in end cap 54 normally retains piston 58 in the position shown in FIG. 2.

A plurality of restricted flow passages 84, preferably in the form of small bore hypodermic needle tubing, extend axially through piston 58 from end to end to accommodate a restricted flow of fluid from one face of the piston to the other upon inertially induced motion of piston 58 in chamber 52. A mercury filled groove 86 extending around the periphery of piston 58 provides a sliding seal between piston 58 and the inner wall of chamber 52.

A flow passage for accommodating flow of fluid from one side of piston 42 to the other is defined by a first bore 88 extending axially entirely through piston 42 and bores 90 and 91 which intersect chamber 52 and bore 88. A plug 92 is press fitted in bore 88, between bores 90 and 91, so that fluid flowing from one end of passage 88 to the other is blocked by plug 92 and is required to flow through bore 90, into chamber 52 and through bore 91. When piston 58 is in the position shown in FIG. 2, flow of fluid from one end for bore 88 to the other is blocked because the piston 58 blocks communication between bores 90 and 91.

A reed valve designated generally 94 is operatively located at the left-hand face of cap 54 of piston 42 as viewed in FIG. 2 and acts as a one-way check valve to prevent flow of fluid through passage 88 from left to right as viewed in FIG. 2. Reed valve 94 is normally maintained in the closed position illustrated in FIG. 2 by a very light leaf spring 96 (or "reed") which will permit the valve to open to accommodate flow of fluid out the left end of passage 88, to thereby permit piston 42 to move to the right as viewed in FIGS. 1 and 2, while preventing piston 42 to move to the left in that leftward movement will be prevented by the fact that valve 94 closes. Movement of piston 42 to the left, as required in testing the invention, is accommodated by opening shut-off valve 34 in bypass conduit 32, enabling fluid at the left-hand side of piston 42 to pass freely through flow passage 50 in piston 40, and thence through the bypass conduit 32 and its opened valve 34 to the right-hand side of piston 42.

OPERATION

In operation, the invention would be mounted with its axis coinciding with the missile's axis and with its illustrated right-hand end facing the missile's nose. As arming piston 58 senses a calibrated low missile reentry drag value, it inertially overcomes the constraint of magnet 82 and begins advancing. Since the rate of advance of arming piston 58, controlled by passages 84, is proportional to the magnitude of force acting on it, i.e., the sensed missile drag, in accordance with the Hagen-Poiseuille law of fluid flow through capillary-type tubes, piston 58 integrates drag with respect to time to thereby measure the missile's velocity reduction.

By design of piston 58, piston chamber 52 and orifices 84, the piston 58 would reach its end limit or arming position approximately midway of the missile's peak drag and near surface drag experiences if the missile traverses the trajectory involving the average referenced velocity reduction of all possible trajectories of the missile system. Since this velocity reduction measurement would terminate well between the missile peak drag and near surface drag experiences in the extreme trajectories involving the least and greatest amounts of velocity reduction between the aforementioned moment of departure of piston 58 from its rest position and the moment the missile reaches near surface fuzing elevation, even at the temperature and hence metering fluid viscosity extremes, the invention does not require a means for varying fluid flow rate in accordance with temperature-caused variance of the viscosity of the metering fluid.

Sealed programming piston 42 is constrained from advancing until its contained arming piston 58 advances sufficiently to open the entrances of its bores 90, 91

(FIG. 2) to thus open its fluid passageway or bore 88. Although near surface drag switching piston 40 is unsealed, it can advance only slightly, to abut piston 42, prior to the opening of the fluid passageway of piston 42.

Figure 3:
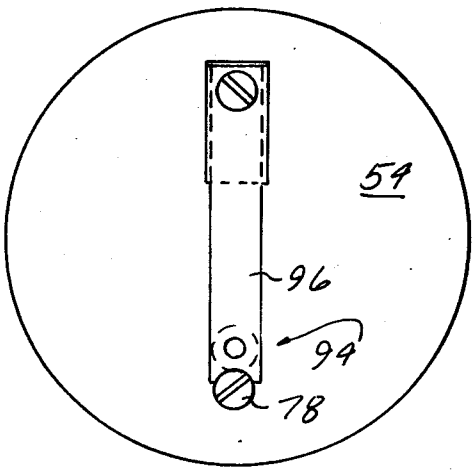
FIG. 3 is a detail end view of the piston assembly of FIG. 2.

FIGS. 4 through 7 inclusive are simplified schematic diagrams of the inertia switch system of FIGS. 1 through 3, illustrating the motions of the various pistons in response to deceleration forces which increase from zero to a peak deceleration and then decrease to a lower level of deceleration, at which lower level it is desired to electrically trigger a device D. Specifically, the deceleration forces which increase from a minimum to a peak deceleration and subsequently decrease represent the drag forces encountered by a missile entering the atmosphere. In FIGS. 4 through 7, the axis of the casing 20 is assumed to be parallel to the longitudinal axis of the missile, the missile being assumed to be traveling from left to right as viewed in FIGS. 4 through 7.

In FIGS. 4 through 7, many of the structural details shown in FIGS. 1 through 3 have been omitted for the sake of clarity. Various features of the respective pistons 40, 42 and 58 described above will be briefly reviewed.

Piston 40 is resiliently biased at all times to the left as viewed in FIGS. 4 through 7 by spring 44 which acts in tension. Apart from the biasing action of spring 44, piston 46 is free to move freely in either direction, the relatively large passage 50 (FIG. 1) through piston 40 accommodating substantially unrestricted flow of fluid from one face of the piston to the other.

Piston 40 carries a metal plate 46 on its lefthand face which is electrically connected by spring 44 to terminal 36 at the left-hand end of the casing 20. The periphery of plate 46 slides on the inner surface of the casing and can electrically contact contacts **28*b* when plate 46 is aligned with contacts 28*b***.

Piston 42 is resiliently biased to the left as viewed in FIGS. 4 through 7 by spring 68 which acts in compression. As described above, referring to FIG. 2, piston 58 can move only to the right as viewed in FIGS. 4 through 7 by virtue of the one-way check valve action of reed valve 94 at the end of passage 88, 90, 91, and can further move to the right only when piston 58 is in a position such that passages 90 and 91 communicate with each other. A conductive plate 62 is carried by piston 42 and is electrically engageable with contacts **28*b* and 28*a* when the piston 42 is appropriately positioned within casing 20. Conductive plate 62 is electrically connected to a lower electric terminal 74 which has an end exposed at the wall of chamber 52 within which piston 58 is slidable. A second electric terminal 70 similarly has an end 72 exposed within chamber 52 and is electrically connected to spring 68 which in turn connects terminal 70 to the external terminal 38 at the right-hand end of casing 20. Terminal 70 and spring 68 are electrically insulated from plate 62 by an insulating pad 66 only partially shown in FIGS. 4 through 7**.

Piston 58, mounted in bore 52 within piston 42, is unbiased in either direction, but its rate of movement in either direction is restricted by the fact that flow of fluid from one face of piston 58 to the other must take place through very small, restricted passages 84, shown in FIG. 2. Piston 58 is normally maintained at the extreme left end of passage 52 by the magnetic coupling 80, 82 (FIG. 2); however, once the coupling is broken and the piston 58 moves slightly away from the left-hand end of passage 52, the magnetic coupling no longer exerts any effect on the motion of piston 58.

Piston 58 is slidably sealed around its periphery to the wall of chamber 52 by a mercury-filled groove 86, the mercury within this groove also being operable to electrically connect the ends 72, 76 of terminals 70, 74 when piston 58 is at its extreme right-hand limit of movement within chamber 52.

Electrical connections externally of casing 20 include the jumper 30 which electrically connects two axially spaced contacts **28*a*, 28*b* as explained above. External terminal 38 at the right-hand end of casing 20 is electrically connected by conductor 98 to one side of a power supply PS whose other side is electrically connected by conductor 102 to one side of the actuating device D. The other side of the electrical actuating device D is connected by conductor 100 to terminal 36 at the opposite end of casing 20**.

Figure 4:
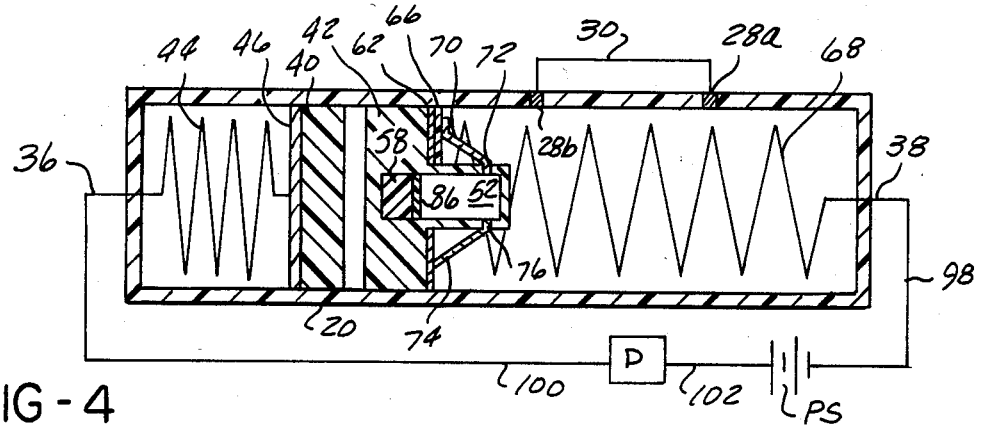
FIGS. 4–7 are schematic views in section showing the device in various stages of operation.
Figure 5:
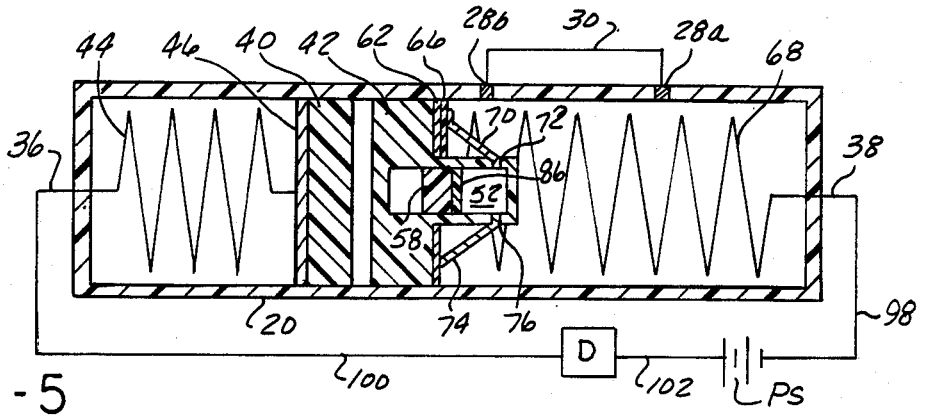

In FIG. 4, the various pistons are shown in their normal rest position.

As the missile begins to reenter the atmosphere, external drag on the missile begins to decelerate the missile, inducing inertial forces tending to move each of pistons 40, 42 and 58 to the right from the piston illustrated in FIG. 4.

Neglecting the biasing action of spring 44, piston 40 is free to move to the right in response to these forces, at least until it engages piston 42.

Initially, piston 42 cannot move to the right in response to these forces, because the flow passage 88, 90, 91 through piston 42 is closed because piston 58 is blocking communication between passage sections 90, 91 (FIG. 2). Eventually, however, the decelerating forces become high enough to break the magnetic coupling 80, 82 (FIG. 2) between piston 58 and piston 42 to permit piston 58 to move to the right relative to piston 42 a distance sufficient to place passage sections 90, 91 in communication with each other. When this occurs, fluid can flow through passage 88, 90, 91 from the right-hand face of piston 42 past check valve 94 to the left-hand side of the piston, thus permitting piston 42 to begin to move to the right, this stage being shown in FIG. 5.

Figure 6:
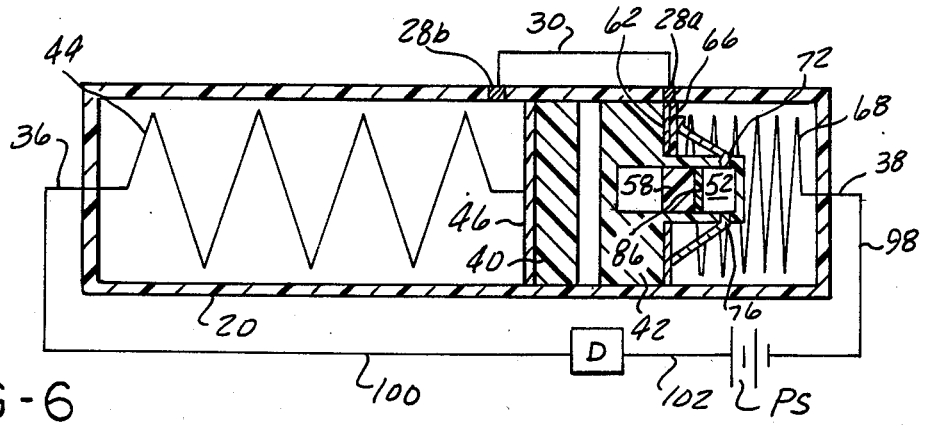
Figure 7:
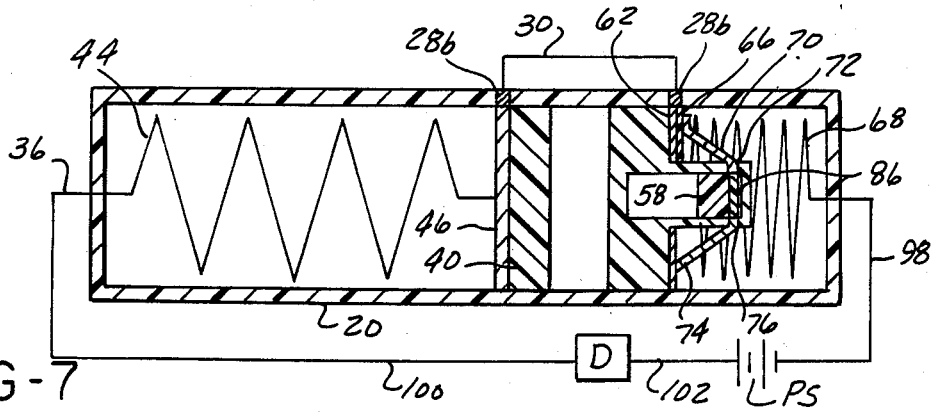

As the drag on the missile steadily increases, the forces applied to the respective pistons also increase and all pistons continue to move to the right until the peak drag level is encountered, at which time the various pistons will be in the positions shown in FIG. 6.

While pistons 40 and 42 have reached their extreme limits of right-hand movement at the peak missile drag level, at which the peak drag forces are counterbalanced by the biasing action of springs 44 and 68, piston 58 is unbiased and continues to move to the right. Piston 58 has not yet reached its extreme right-hand limit of travel because it is substantially slowed by the restricted flow of fluid from one face of piston 58 to the other imposed by the restricted passages 84 (FIG. 2). At peak drag, as indicated in FIG. 6, plate 62 on piston 42 is in electrical contact with contact **28*a*. As the drag level exerted on the missile begins to reduce as the peak drag level is passed, piston 42 remains in the position it assumed in FIG. 6, because the reed valve 94 (FIG. 2) closes passages 88, 90, 91 to prevent the flow of fluid from the left-hand face of piston 42 to the right-hand face, thus hydraulically locking piston 58 in the FIG. 6** position.

As the drag level reduces, piston 58 continues to travel to the right until it reaches the right-hand end of chamber 52, the mercury ring 86 at this time electrically connecting the exposed tips 72, 76 of terminals 70, 74 to each other, thereby completing an electrical circuit from external terminal 38 via spring 68, terminal 74, and plate 62 to contact 28*a* and thence via jumper 30 to contact 28*b*.

It will be noted that in the peak drag configuration shown in FIG. 6, piston 40 has advanced to the right a distance sufficient to place its switch plate 46 to the right of contact 28*b*. As the drag and deceleration forces become reduced, the biasing action of spring 44 begins to draw piston 40 back to the left from the FIG. 6 position, and when switch plate 46 on plate 40 engages conduit 28*b*, an electrical circuit through actuating device D is completed. This circuit extends from conductor 98 at one side of power supply PS to external terminal 38, thence through spring 68 to terminal 70, via mercury ring 86 on piston 58 to terminal 74 to plate 68 to contact 28*a* via jumper 30 to contact 28*b* and thence switch plate 46, spring 44, terminal 36 and conductor 100 to the actuating device D which in turn is connected by conductor 102 to the opposite side of power supply PS.

EMBODIMENT OF FIGS. 8 AND 9

Figures 8, 9:
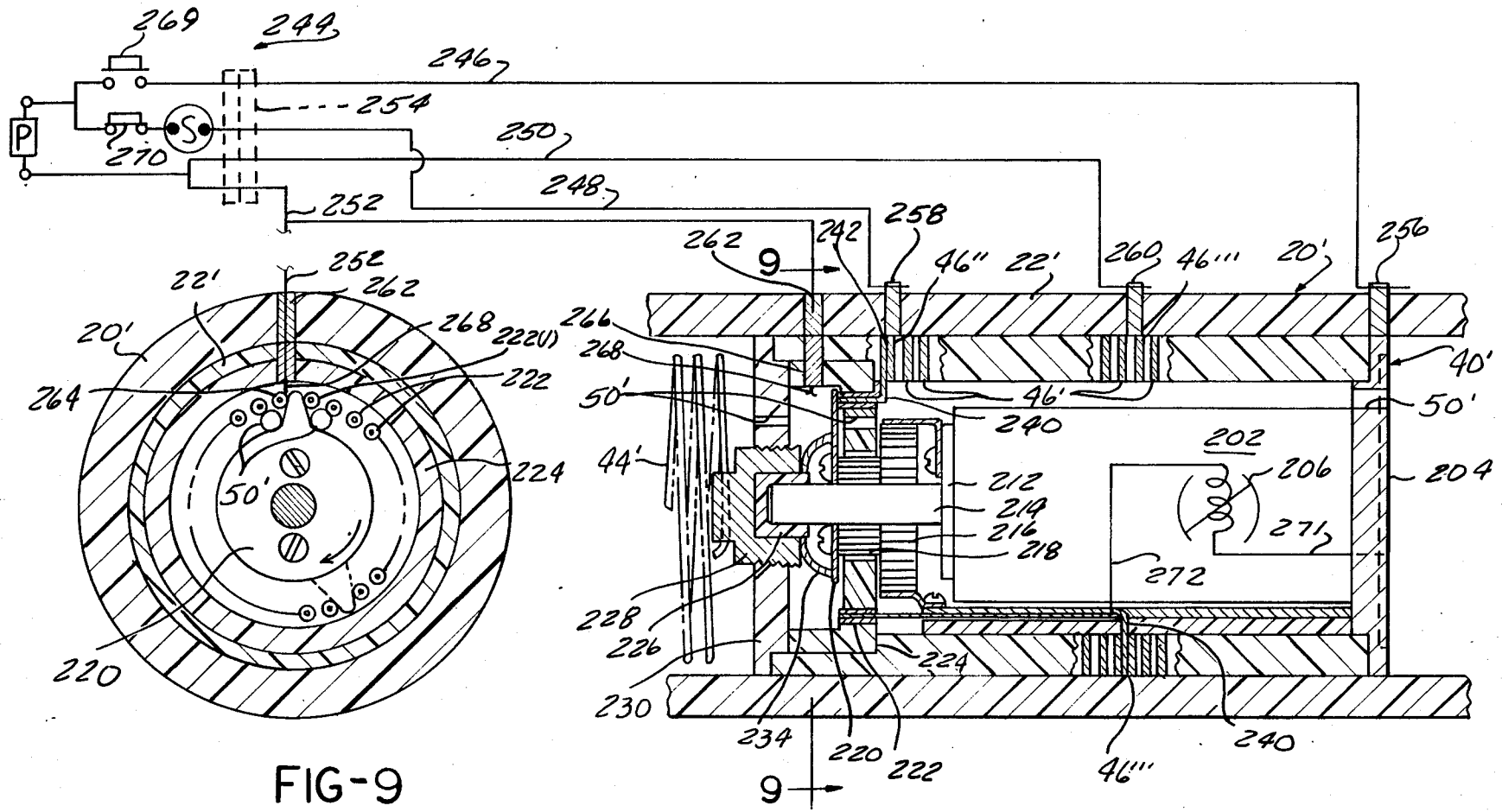
FIG. 8 is a cross-sectional view of a modified form of piston assembly.
FIG. 9 is a cross-sectional view taken on line 8—8 of FIG. 7.

A modified form of piston 40 is shown in FIGS. 8 and 9 which effectively, in terms of the FIG. 1 embodiment, enables an axial adjustment of the location of switch plate 46 relative to piston 40.

To accomplish the foregoing purpose, the piston 40' of FIGS. 8 and 9, instead of having a single switch plate 46 as in the FIG. 1 embodiment, has a plurality of axially spaced, annular contact rings 46' embedded in its side wall and exposed at both the interior and exterior of the piston, which is hollow in the FIGS. 8 and 9 embodiment. Each of the individual contact rings 46' is electrically connected to one of a plurality of individual electric contacts of a rotary stepping switch designated generally 202 which is mounted within the interior of piston 40'. Stepping switch 202 is mounted upon a metal end plate 204 which forms the right-hand end wall of piston 40' and the outer periphery of plate 204 is machined flush with the piston periphery and mercury wetted, as are the outer peripheries of contact rings 46', to electrically contact various contacts embedded in the wall of central section 22' of casing 20'.

Stepping switch 202 includes a solenoid 206 operable, when energized, to drive a rotor 212 and attached rotor shaft 214 in one step of rotary movement controlled by a ratchet 216. A hub 218 fixedly mounted on rotor shaft 214 carries a rotary contact 220 which, during the step-by-step movement of the stepping switch rotor, rotatably moves from electrical contact bridging one pair of adjacent individual contacts 222 to the adjacent pair. The individual contacts 222 are individually electrically connected to the respective rings 46'. Contacts 222 are mounted within a stationary contact plate 224 of electrically insulative material.

The left-hand end of rotor shaft 214 is rotatively received in an electrically insulated bearing 226 which is in turn housed within an electrically conductive terminal 228 fixedly and threadably received within the left-hand end cap 230 of piston 40'. Terminal 228 is electrically connected to the end of spring 44' and also, via a Belleville spring washer 234 to rotary contact 220.

A fluid flow passage 50' is established through piston 40'.

The electrical connections between the individual stepping switch contacts 222 and the respective contact rings 46' are established by L-shaped connecting leads, one of which is indicated at 240, the remaining connectors being omitted for the sake of clarity.

Selection of a particular contact ring 46' is accomplished by the operation of an external electric circuit programmer designated generally 244. Conveniently, programmer 244 may be electrically connected to various leads 246, 248, 250 and 252 permanently located within the missile of means of a separable 4-prong electrical connector schematically indicated at 254 to the externally located programmer so that the selection of the appropriate contact ring 46' may be made from the exterior of the missile just prior to launch. Lead 246 is connected to an electric contact 256 embedded in the wall of casing 20' and exposed at the interior of the casing to contact the metal end plate 204 of the stepping switch 202 during the programming operation. Lead 248 is connected to a similar contact 258 embedded in the casing wall which, during the programming operation, engages left-hand connect ring 46'' which is electrically connected to what will be referred to as the number 1 contact 222(1) of contacts 222.

Lead 250 is connected to a third contact 260 embedded in the casing wall to a contact 46''' which represents the middle ring (axially) of the plurality of rings 46'. Lead 252 is electrically connected via a fourth contact 262 embedded in the casing to a "home" contact 264 of the stepping switch which is immediately to the left of the above referred to number 1 contact 222(1). Contact 262 is connected to contact 264 via a stud 266 and lead 268.

The external programmer 244 includes a power source PS and manually operable, normal open and normal closed switches 269 and 270 respectively.

The appropriate contact ring 46' is selected by assigning the rings numbers representative of the number of the connected contact 222.

With the electrical connections as shown in FIG. 8, the rotor 220 of stepping switch 202 is advanced by repeated closures of switch 269 to actuate stepping switch 202. From the upper side of power source PS, this actuating circuit passes through the temporarily closed switch 269, and then via lead 246 and contact 256 to plate 204, thence via lead 271 through the coil 206 of the stepping switch, and from the coil via lead 272 to the central contacts 46''' to contact 260 and back to the opposite side of power source PS via lead 250. Each actuation of switch 269 advances the stepping switch one step until the stepping switch contact bridges the "home" contact 264 and the number 1 contact 222(1).

At this time, the stepping switch energizing circuit is shorted out by a circuit which extends from the upper side of power source PS as viewed in FIG. 8 through the normally closed contact 270, a signal device S, lead 248 and contact 258, contact ring 46'' which is connected to number 1 contact 222(1) through the stepping switch contact to "home" contact 264 and thence via lead 268, stud 266, contact 262 and lead 252 to the other side of power source P. This shorting circuit prevents further advance of the stepping switch, even though switch 269 may be inadvertently actuated again, and the signal element S energized by completion of the shorting circuit indicates the rotary contact element 220 of the stepping switch is at its home position.

Assuming the desired contact 46' is the number 8 contact, switch 270 is then actuated to open the shorting circuit, and then switch 269 is actuated once to move the stepping switch contact one step away from its home position. Seven more successive depressions of push button 269 will advance the rotary stepping switch contact 220 a total of eight steps away from its home position to electrically connect the number 8 contact plate 46' to spring 44' via rotor 220, Belleville spring 234 and terminal 228.

While two exemplary embodiments of the invention have been described in detail, it will be apparent to those skilled in the art the disclosed embodiments may be modified. Therefore, the foregoing description is to be considered exemplary rather than limiting, and the true scope of the invention is that defined in the following claims.

I claim:

1. An inertia switch system comprising a sealed casing having a front and a rear end and an elongate fluid-filled main piston chamber therein aligned with the fore and aft axis of said casing, a first piston slidably received in said main chamber having a first fluid flow passage therethrough accommodating substantially unrestricted flow of fluid from one side of said first piston to the other, first spring means biasing said first piston toward the rearward end of said main chamber, a second piston slidably received in said main chamber in front of said first piston and having a second fluid flow passage means therethrough operable to accommodate flow of fluid from one side of said second piston to the other, second spring means biasing said second piston toward the rearward end of said main chamber, means defining an elongate second chamber within said second piston extending parallel to said main chamber, a third piston slidably received in said second chamber and having a third flow passage therethrough accommodating a restricted flow of fluid from one side of said third piston to the other, said pistons being movable within their respective chambers in inertial response to acceleration applied to said casing, each of said pistons including a peripherally extending, electrically conductive member at a fixed location on the piston in sliding engagement with the wall of the chamber in which the piston is received, a first series of electrical contact means located at axially spaced positions in said casing and having exposed contact surfaces flush with the wall of said main chamber, a first and a second contact means of said series being electrically connected to each other by conductive means and being adapted to be engaged respectively by said conductive members of said first and second pistons when said pistons are at respective first and second predetermined locations in said main chamber, and third electric contact means at spaced positions in the wall of said second chamber located to be simultaneously engaged by the conductive member of said third piston when said third piston is at a selected axial location within said second chamber.

2. The invention defined in claim 1 wherein said first and second spring means are electrically conductive and are each electrically connected at one end to the conductive members on the respective first and second pistons, first and second electric terminals fixedly mounted in and projecting from said casing, means electrically connecting the other ends of said first and second spring means respectively to said first and second terminals, electric connections between said first and second terminals can be established when the conductive member on said first piston engages the first contact means and the conductive member of said second piston engages the second contact means.

3. The invention defined in claim 2 wherein the means electrically connecting said second spring means to said second terminal comprises said third contact means and the conductive member of said third piston.

4. The invention defined in claim 3 further comprising one-way check valve means in said second fluid passage means operable to block flow through said second passage means in a direction accommodating rearward movement of said second piston, said second contact means being located to be engaged by the conductive member of said second piston when said second piston is at a forward limit of movement within said main chamber representative of a peak acceleration level and said first contact means being located to be engaged by the conductive member of said first piston where said first piston is at a location intermediate its end limits of movements within said main chamber representative of an acceleration level less than said peak level.

5. The invention defined in claim 1 wherein the conductive member of said first piston comprises a plurality of axially spaced conductive elements electrically insulated from each other, and means operable from the exterior of said casing for electrically connecting any selected one of said elements to said first spring means.

* * * * *